US005352465A

United States Patent [19]

Gondek et al.

[11] Patent Number: 5,352,465

[45] Date of Patent: Oct. 4, 1994

[54] DISPOSABLE, MICROWAVEABLE, FOOD STORAGE CONTAINER

[75] Inventors: Charlene Gondek, Boca Raton; Trevor Nicholson, Fort Lauderdale; Robert Waszak, Pompano Beach, all of Fla.; Kathleen D. Taggares, Los Angeles, Calif.

[73] Assignee: Vendtron, Inc., Pompano Beach, Fla.

[21] Appl. No.: 963,054

[22] Filed: Oct. 19, 1992

Related U.S. Application Data

[63] Continuation-in-part of Ser. No. 934,567, Aug. 24, 1992, abandoned, which is a continuation-in-part of Ser. No. 925,090, Aug. 4, 1992, abandoned.

[51] Int. Cl.[5] ..... A23L 1/025; B65B 25/22; B65D 81/34

[52] U.S. Cl. ..... 426/87; 219/730; 219/734; 426/107; 426/110; 426/113; 426/234; 426/396; 426/398

[58] Field of Search ..... 426/87, 107, 110, 113, 426/114, 234, 243, 396, 398; 219/10.55 E

[56] References Cited

U.S. PATENT DOCUMENTS

| | | | |
|---|---|---|---|
| 4,190,757 | 2/1980 | Turpin et al. | 219/10.55 E |
| 4,260,060 | 4/1981 | Faller | 206/622 |
| 4,450,334 | 5/1984 | Bowen et al. | 219/10.55 E |
| 4,555,605 | 11/1985 | Brown et al. | 219/10.55 E |
| 4,592,914 | 6/1986 | Kuchenbecker | 426/107 |
| 4,794,005 | 12/1988 | Swiontek | 426/107 |
| 4,891,482 | 1/1990 | Jaeger et al. | 219/10.55 E |
| 4,896,009 | 1/1990 | Pawlowski | 219/10.55 E |
| 4,916,279 | 4/1990 | Brown et al. | 219/10.55 E |
| 4,960,598 | 10/1990 | Swiontek | 426/107 |
| 5,041,295 | 8/1991 | Perry et al. | 426/107 |

*Primary Examiner*—Leo B. Tentoni
*Attorney, Agent, or Firm*—Krass & Young

[57] ABSTRACT

A disposable package assembly for storage and subsequent microwave heating of a food item. The package assembly includes a container body having one or more raised lands integrally formed on the bottom surface thereof. The one or more raised lands support a microwave browning disk, and a food item is supported upon the browning disk. The one or more raised lands create an air space between the bottom of the container body and the browning disk to promote even circulation of heated air. A lid is disposed over the container body to enclose the food item.

15 Claims, 3 Drawing Sheets

FIG-1
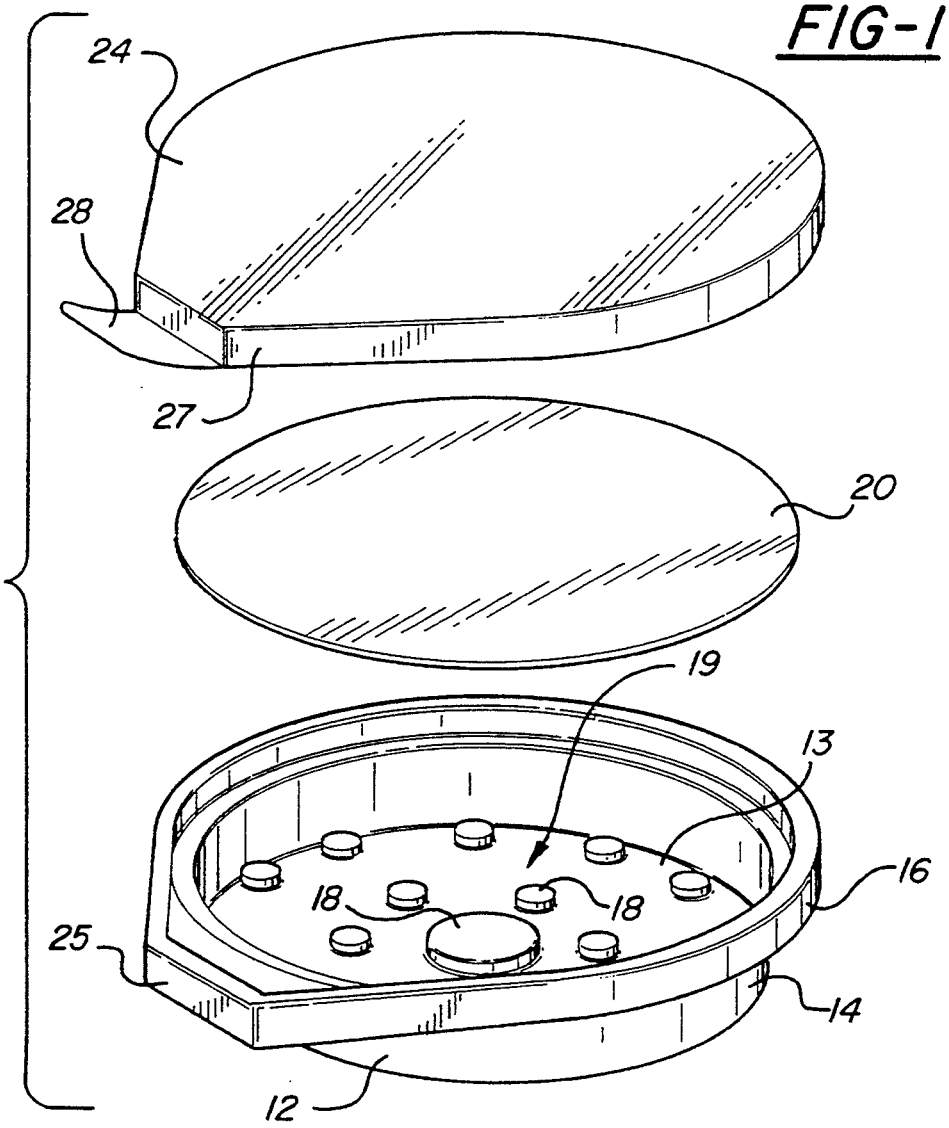
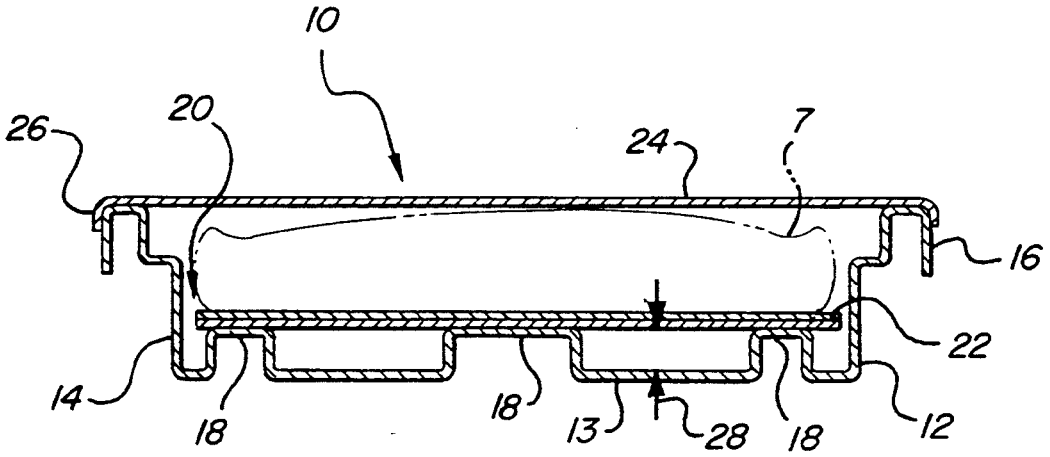
FIG-2

DISPOSABLE, MICROWAVEABLE, FOOD STORAGE CONTAINER

REFERENCE TO RELATED APPLICATION

This a continuation-in-part of Ser. No. 07/934,567, filed Aug. 24, 1992 and now abandoned, which application is, in turn, a continuation-in-part of Ser. No. 07/925,090, filed Aug. 4, 1992 and now abandoned.

FIELD OF THE INVENTION

This invention concerns the field of disposable package assemblies for containing a food item and, more particularly, to such a package assembly adapted for both freezer refrigerator storage and subsequent microwave heating of said food item.

DESCRIPTION OF THE RELEVANT PRIOR ART

The popularity of food items which may be removed from freezer or refrigerator storage and transferred to a microwave oven for subsequent reheating or cooking has grown tremendously in recent years. Consumers particularly prefer such food items which are provided in containers suitable for both freezer or refrigerator storage and subjection to microwave radiation. Such products may be bought by consumers as frozen or chilled items which are stored at home and then microwaved, or purchased from a vending machine including a refrigerated compartment and a microwave oven unit, such as is described in copending U.S. application Ser. No. 886,790, assigned to the assignee of the present application.

Obviously, a container which is suited for both long-term refrigerator/freezer storage of a food product and subsequent microwave irradiation must have a number of desirable, sometimes conflicting, characteristics. First of all, if the container is to be disposable, it must be easily manufactured from inexpensive substances such as paper, plastic, fiberboard, etc. In order to preserve the taste and quality of the food during refrigerated storage, the container must be reasonably airtight. It must have a compact and stackable configuration so as not to waste storage space. It must be formed of materials which hold up to microwave radiation without melting, deforming or burning, but also permit microwave radiation to pass through so that the food item will be heated.

One particularly difficult problem to solve in package assemblies of this type is designing the package so that the food will heat evenly (without hot spots) in a reasonable amount of time. Also, the package assembly must allow the product to be heated or cooked to an appetizing condition; that is, if the product has a bottom crust, the crust should be evenly browned, and the entire food product should exhibit no sogginess.

A number of attempts have been made in the prior art to design a food package assembly particularly adapted for microwave heating. See, for example, U.S. Pat. Nos.: 4,260,060; 4,190,757; 4,891,482; 4,960,598; 4,794,005; 4,555,605; and 4,592,914. Most of the package assemblies disclosed in these references consist of square or rectangular containers which are folded from cardboard blanks. Moreover, at least one attempt has been made to design a non-disposable container particularly suited for heating a crusted food product, such as pizza in a microwave oven. See U.S. Pat. No. 4,450,334.

Of course, the microwave pizza maker disclosed in the '334 patent is not intended for use as a disposable unit.

A number of the references disclosed in the prior paragraph describe containers which are particularly useful for heating crusted foods such as pizza; they attempt to solve the problem of browning or crisping the lower crust by including a layer or support surface of a microwave-susceptible or microwave-interactive material, such as a very thin, lossy layer of a substance such as aluminum, ferrites, carbon particles, or other metal and metal compounds. Often, the microwave-interactive layer is coated upon a microwave transparent layer to create a food support surface. U.S. Pat. Nos. 4,896,009 and 4,916,279 disclose microwave "browning" disks of this construction.

While the prior art efforts have achieved some success, all of them possess one or more disadvantages: they do not prevent quality loss of the food item during storage; they do not heat the food item evenly; they do not crisp and brown the bottom crust of a food item such as pizza; they become saturated with grease during reheating; they form hot spots which burn the fingers of the consumer; they do not store compactly; or they are not sufficiently inexpensive to manufacture so as to be disposable.

Thus, what is needed is a food package assembly which can go straight from the refrigerator/freezer to the microwave oven, which heats a food item stored therein evenly, without sogginess or hot spots, which browns and crisps the crust of pizza or other crusted food, which is compact to store, which is inexpensive to manufacture, which is easy to use, and which does not become saturated with grease when the food item is heated or cooked.

SUMMARY OF THE INVENTION

The invention described and claimed herein has been designed to overcome the problems with the prior art noted above. The invention is a disposable package assembly for freezer or refrigerator storage of a food item and subsequent microwave heating or cooking. The package assembly comprises a molded container body which is formed of a substance substantially transparent to microwave radiation. The container body is configured to receive the food item therein; in one preferred embodiment, the food item is a circular pizza and the container body is also circular to accommodate it. The container body includes a flat bottom and a side wall integrally formed thereon. Optionally, a groove is formed on the inside surface of the sidewall proximate the bottom.

At least one raised land is integrally formed on the container bottom to define a raised support surface. Typically, at least one relatively large land or, alternatively, group of small lands will be disposed proximate the centerpoint of the container bottom; other raised lands may be disposed adjacent the side wall at intervals therealong. Whether singular or plural, the surfaces of the one or more raised lands, taken together, form a support surface which will support a food item thereon without causing the food item to sag.

A disk including a layer of microwave-susceptible material disposed on a surface thereof is supported on the support surface formed by the one or more raised lands. The disk may further be supported in the optional side wall groove. The microwave-susceptible material converts incident microwave radiation into heat, thereby helping to brown and crisp the lower surface of a food item disposed thereon. Because the disk is supported by the one or more raised lands, rather than directly upon the container bottom, an air space is created between the disk and the container bottom. The air space permits the free circulation of heated air along the entire disk, thereby evenly heating the food item disposed thereon.

The package assembly of the present invention further comprises a lid which is formed of a substance substantially transparent to microwave radiation. The lid is configured to cover the container to enclose a food item placed therein. It can include a downwardly-depending skirt which is formed on the periphery of the lid for engagement with the side wall of the container in order to secure the lid to the container. Alternatively, the microwave transparent cover may be formed of a polymeric film of the "shrink wrap" variety. The film is applied to the container having the food item therein and heated to "shrink wrap" it onto the container, in a manner known in the art. The excess film is then die-cut off.

In a preferred embodiment of the package assembly of the present invention, the side wall of the container further includes a downwardly-depending lip integrally formed on the side wall for engagement with of the lid. This arrangement helps improve the airtightness of the package assembly to inhibit deterioration of food quality.

In another preferred embodiment, the package assembly further comprises an integral handle portion graspable by a user which is molded into the container body and extends outboard of the side wall. The handle allows the package assembly to easily be removed from a microwave oven without burning the hand of a user.

The one or more raised lands may take a variety of configurations. In one embodiment, the lands are formed as indicia which are readable by the user on the container bottom. Such indicia may include, for example, a description of the food product, the vendor's name and/or trademark, etc. Alternatively, the lands can be in the form of cylindrical dimples, flat surfaced grooves, etc. In a particularly preferred embodiment, a single raised land is in the form of an annular ring radially spaced from the centerpoint of the circular container bottom. In cooperation with the side wall groove already mentioned, the ring effectively supports and retains the browning disk in the container.

In an alternate embodiment of the package assembly of the present invention, the assembly further comprises a spacer which is also comprised of a substantially microwave transparent material, and includes a second plurality of raised lands formed thereon. The spacer is disposed between the container bottom and the browning disk and defines a second air space between the spacer and the disk in order to promote circulation of heated air to evenly heat the food product.

In yet another alternate embodiment, the package assembly includes a disk having a layer of microwave-susceptible formed thereon and with a plurality of holes formed therein at locations selected to be in registry with a plurality of raised lands of the container body so that at least a portion of each land protrudes through one of the holes formed in the disk. It has been found that such an arrangement helps to secure the disk to the container body to facilitate the removal of the heated food product therefrom.

BRIEF DESCRIPTION OF THE DRAWINGS

The following detailed description may best be understood with reference to the following drawings in which:

FIG. 1 is an exploded view of a food package assembly constructed according to the principles of the present invention and showing the various components thereof;

FIG. 2 is a cross-sectional view along lines 2—2 of FIG. 1 and shows the components thereof in their assembled relationship;

DETAILED DESCRIPTION OF THE PREFERRED EMBODIMENT

Figure 3:
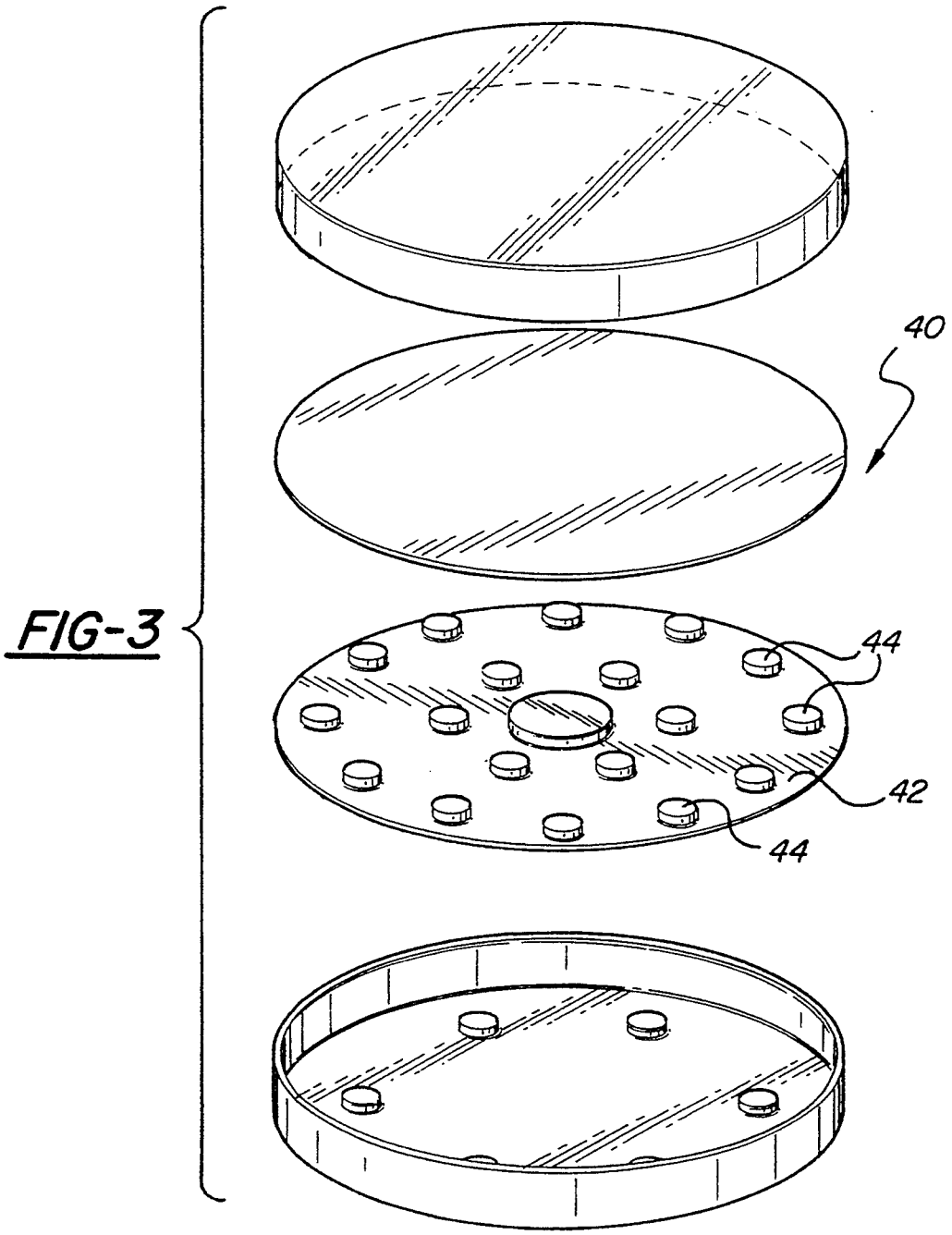
FIG. 3 is an alternate embodiment of a food package assembly according to the present invention.

Throughout the following detailed description, like reference numerals are used to refer to the same element of the invention shown in multiple figures thereof. Referring now to the drawings and in particular to FIGS. 1 and 2, there is shown a package assembly 10 of the present invention suitable for refrigerator/freezer storage of a food item and subsequent microwave reheating or cooking. The package assembly 10 illustrated in the figures is designed to contain individual frozen or refrigerated pizzas. However, it is to be understood that the package assembly, depending on its configuration, can contain a variety of food items which are customarily refrigerated or frozen and then cooked or reheated in a microwave oven.

The package assembly 10 comprises a container body 12 including a flat bottom 13 and a side wall 14 integrally formed thereon. A downwardly-depending lip 16 is integrally formed on side wall 14. As illustrated, the container body 12 also includes an outwardly projecting handle portion 25.

A plurality of flat surfaced, raised lands 18 are integrally formed on the bottom surface 13 of container body 12. Together, the plurality of lands 18 define a support surface 19 which, as can most clearly be seen in FIG. 2, acts to support a disk 20 which, in turn, supports a food item 7 disposed thereon. Because the plurality of lands 18 are raised, the support surface 19 is raised above the flat bottom 13 of container 12. Thus, when disk 20 is placed on support surface 19, the lands 18 define an air space 28 between itself and the container bottom 13.

The disk 20 includes a layer 22 of a microwave-interactive substance disposed thereon. Preferably, the layer 22 is formed of a material such as a lossy layer of aluminum and may be coated with a thin layer of MYLAR® plastic film, as disclosed in U.S. Pat. Nos. 4,916,279 and 4,896,009. Of course, since the package assembly disclosed herein is designed to be disposable, it is important that disk 20 be easily manufactured of inexpensive materials. For example, the layer of microwave-interactive substance 22 may be supported upon an inexpensive, microwave-transparent material such as various moldable plastics, cardboard, paste board, etc.

The package assembly 10 further includes a lid 24 which is configured to fit over the container body 12 to enclose food item 7. In the embodiment depicted in FIG. 1, the container body 12 includes handle portion 25 so lid 24 includes a corresponding handle portion 27. A skirt 26 projects downwardly from lid 24. Optionally, for easy opening of the package assembly, a flexible tab 28 may project outwardly from handle portion 27. The lid 24 may then be easily removed from the container body 12 simply by grasping the tab 28 and pulling outwardly and upwardly.

The skirt 26 formed on lid 24 is designed to fit over and engage downwardly-depending lip 16 of container body 12. It has been found that the arrangement depicted forms a reasonably airtight seal to protect the integrity and quality of the food item 7 stored therein. Preferably, the lid 24 is formed of a flexible, easily moldable polymeric material such as so that the lid will flex over the container, and the skirt 26 will deform outwardly to form an airtight seal with lip 16. Alternatively, lid 24 may be formed of a "shrink wrap" polymeric film. The film is applied to the container body 12 and heated to shrink it onto the container. The excess is die-cut off. The shrink wrap film cover forms an inexpensive, air tight seal.

The container body 12 is also formed of an easily moldable, preferably polymeric material which, like the substance of which the lid 24 is molded, is substantially transparent to microwave radiation. However, it is desirable that the substance of which the container body 12 is molded be somewhat more rigid than the lid so that the contents of the package assembly 10 will remain intact during handling and storage. Substances suitable for this purpose include polyesters, polyoefins, polyvinylchlorides, polyvinylactetates, and the like. Alternatively, the container body 12 may be formed of plastic coated cardboard or fiber board which can easily be molded to include the structures described herein.

Figure 4:
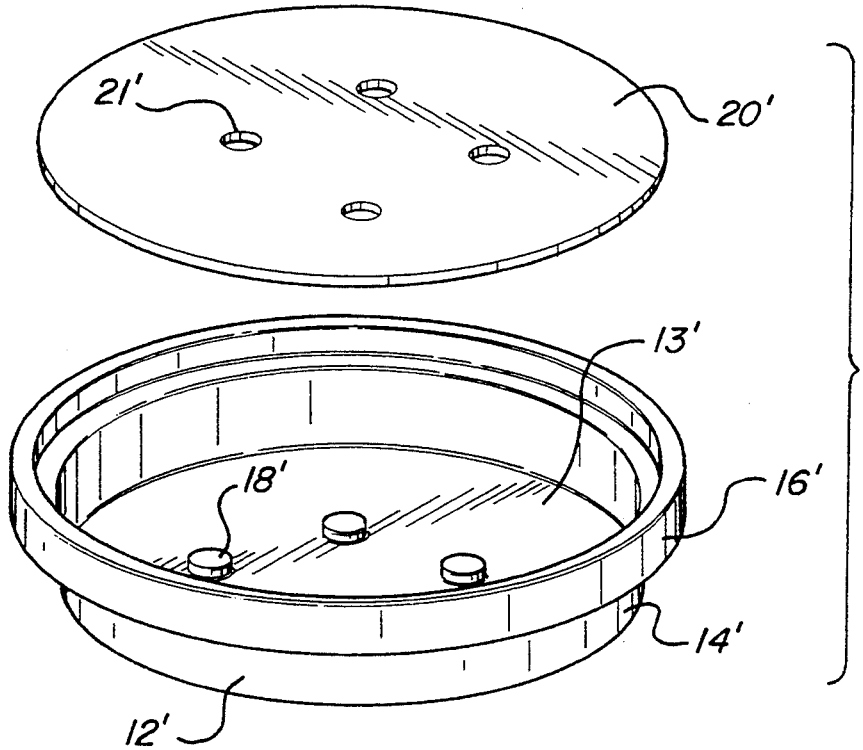
FIG. 4 is an exploded view of yet another alternate embodiment of a food package assembly according to the present invention showing the container body and disk thereof.

An alternate embodiment of the food storage container of the present invention is depicted in FIG. 4. In this embodiment, the container body 12' has a plurality of raised lands 18' formed on its bottom surface 13'. A plurality of apertures 21' are formed in microwave browning disk 20' at locations thereon in registry with the lands 18'. When the disk 20' is positioned in the container body 12', at least a portion of each land 18' will protrude through its corresponding aperture 21', thus securing disk 20' inside container body 12'. This arrangement makes it easier to remove the heated food item from the container body 12' without the item adhering to the disk 20' due to the adhesion of, for example, melted cheese. In practice, it has been found that there remains a sufficient airspace between bottom surface 13' and disk 20' to serve the function of circulation of heated air as described above, even if the entirety of lands 18' protrude through their respective apertures 21''.

In manufacturing the embodiment of the invention depicted in FIG. 4, it may be desirable to first mold the container body 12' without any lands 18'. The disk 20' is inserted into the molded body 12'', and the lands 18' are then molded in place. The food item may then be placed on the disk and a plastic film cover heat sealed over the container body as described above.

Figure 6:
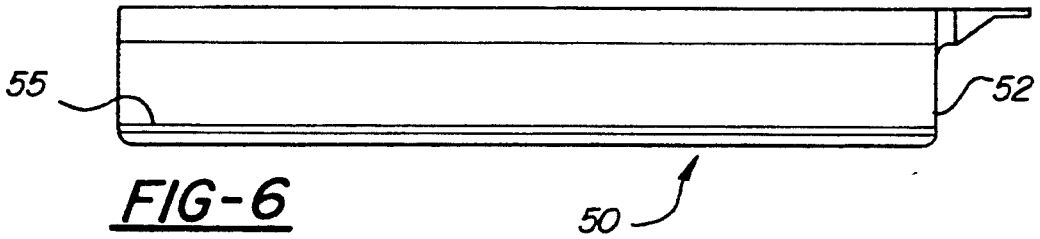
FIG. 6 is an opposite side view of the assembly of FIG. 5.
Figure 5:
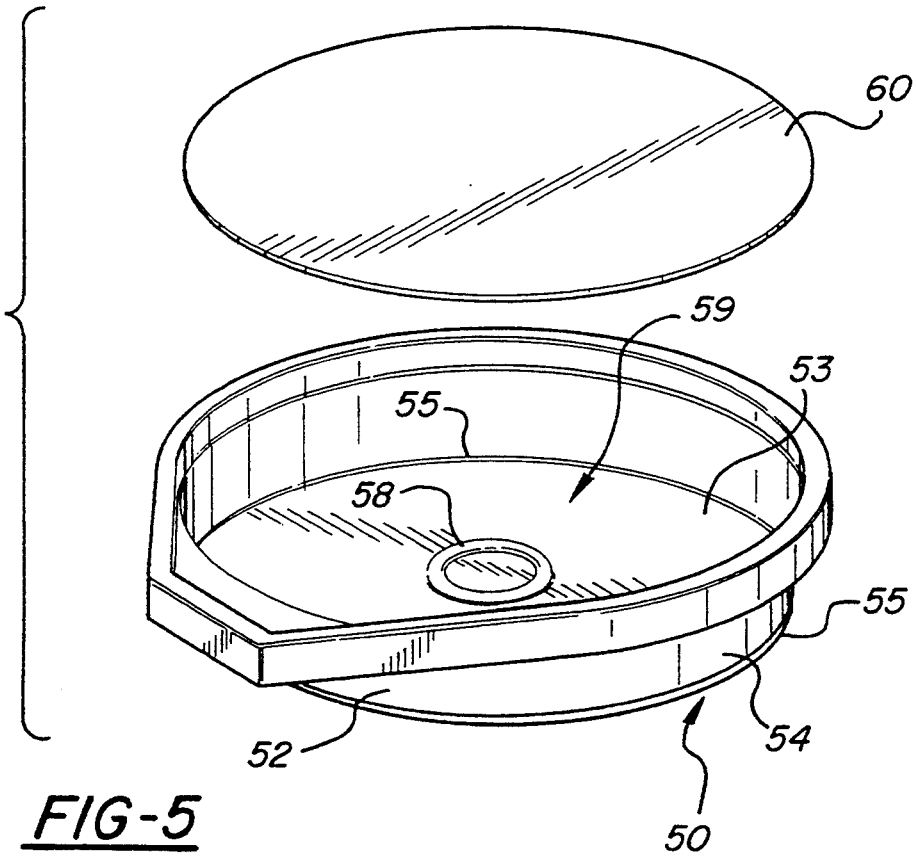
FIG. 5 is an exploded view of yet another alternate embodiment of a food package assembly according to the present invention showing the container body and disk thereof.

In another alternative embodiment of the container of the present invention shown in FIGS. 5 and 6, a container assembly 50 includes a container body 52 including a flat bottom 53 and a side wall 54 integrally formed thereon. Molded into sidewall 54 is a groove 55 which extends for the entire circumference of side wall 54. Groove 55 is disposed on the inside surface of side wall 54 proximate flat bottom 53, as can best be seen in the side view of FIG. 6.

A single raised land in the form of an annular ring 58 is formed on flat bottom 53. Ring 58 is radially disposed from the centerpoint of the flat bottom 53 in the manner depicted in FIG. 5. Ring 58 forms support surface 59 which supports microwave browning disk 60. In addition to being supported by annular ring 58, disk 60 is also retained in groove 55. It has been found that annular ring 58 and groove 55 cooperate effectively to both support and retain disk 60 in container body 52. The embodiment depicted in FIGS. 5 and 6 is particularly simple to mold and manufacture.

Use of the package assembly disclosed herein is extremely simple. The food item 7 is simply placed inside the container body 12 and supported upon the disk 20. The lid 24 is then placed upon the container body. Optionally, it may be sealed in some fashion known in the prior art. The package assembly is then storable in freezer or refrigerator until needed. The configurations disclosed in the Figures are particularly adaptable for stacking storage of a plurality of food items, such as is encountered in vending machine situations, like that disclosed in copending application No. 886,790. Both the top and bottom surface of the package assembly are flat, thus promoting even stacking.

When the user wishes to heat or cook the food item 7, the package assembly 10 is removed or rended from its storage compartment and simply placed inside a conventional microwave oven. Since the container body 12 and lid 24 are substantially transparent to microwave radiation, the microwaves will penetrate to the food item, thus causing an increase in temperature in a manner well known in the prior art. As the water molecules present in the food item become hotter, they will vaporize from the food item. The air space 28 formed between disk 20 and bottom surface 13 of container body 12 promotes the circulation of the heated water vapor, thus contributing to even heating and absence of hot spots in the finished food item. Due to the presence of the layer of microwave-susceptible material 22, the microwaves impinging upon the disk 20 will be converted to heat energy, thus browning and crisping the bottom crust of the food product. Preferably, and in order to reduce the possibility of hot spots, the food item is allowed to stand for a short period of time before the package assembly is opened and the food item removed.

Because the package assembly disclosed herein reduces the frequency of hot spots and promotes overall even heating of the food item, it is particularly useful to contain vended food items which are heated or cooked before consumption. The elimination of hot spots considerably reduces the possibility of the user being burned by the vended product.

An alternate embodiment of the package assembly is shown in FIG. 3. The alternate embodiment 40 of the present invention further includes a spacer 42 formed of a substantially microwave transparent material disposed on top of the support surface of the container body. The spacer 42 includes a second plurality of raised lands 44 which, in turn, support the browning disk. The purpose of the spacer 42 is to create a second air space between itself and the browning disk to promote even better circulation of heated air to evenly heat the food item. This arrangement may prove particularly useful for larger food items, such as pizzas larger than individual serving size.

The present invention has been described with reference to certain embodiments and exemplifications thereof. Other variations in design may occur to one skilled in the art by employing the teachings of the present invention. However, the present invention is not defined by the illustrated embodiments and exemplifications but, rather, solely by the claims appended hereto and all equivalents thereof.

We claim:

1. A disposable package assembly for freezer storage and subsequent microwave heating of a food item comprising:

a molded container body substantially transparent to microwaves and configured to receive said food item therein, said container body including a flat bottom and a side wall formed integrally thereon;

at least one raised land integrally formed on said container bottom and defining a raised support surface having a depending side wall integrally formed along an entire periphery thereof;

a disk for receiving said food item including a microwave-susceptible material disposed on a surface thereof to convert incident microwave energy to heat, said disk being supported on said support surface to define at least one air space between said container bottom on said disk; and a lid substantially transparent to microwaves and configured to cover said container to enclose said food item.

2. A disposable package assembly for freezer storage and subsequent microwave heating of a food item comprising:

a molded container body substantially transparent to microwaves and configured to receive said food item therein, said container body including a flat bottom and a side wall formed integrally thereon;

at least one raised land integrally formed on said container bottom and defining a raised support surface;

a disk for receiving said food item including a microwave-susceptible material disposed on a surface thereof to convert incident microwave energy to heat, said disk being supported on said support surface to define at least one air space between said container bottom on said disk;

a lid substantially transparent to microwaves and configured to cover said container to enclose said food item, wherein said at least one raised land is configured as an annular ring spaced radially around a centerpoint of said container bottom.

3. The package assembly of claim 2 further comprising an annular groove formed on an inside surface of said side wall proximate said container bottom, said groove cooperating with said ring to retain and support said disk.

4. The package assembly of claim 1 wherein said lid further comprises a downwardly depending skirt formed on the periphery thereof for engagement with said container side wall to secure said lid to said container.

5. The package assembly of claim 4 wherein the container body further includes a downwardly depending lip integrally formed on said side wall for engagement with said skirt.

6. The package assembly of claim 1 further comprising a handle portion molded into said container body and disposed outboard of said side wall thereof.

7. The package assembly of claim 1 wherein the lid is formed of a polymeric film shrink wrapped onto the container body.

8. The package assembly of claim 1 wherein said container body is circular in configuration to contain a circular food item.

9. A disposable package assembly for freezer storage and subsequent microwave heating of a food item comprising:

a molded container body substantially transparent to microwaves and configured to receive said food item therein, said container body including a flat bottom and a side wall formed integrally thereon;

at least one raised land integrally formed on said container bottom and defining a raised support surface;

a disk for receiving said food item including a microwave-susceptible material disposed on a surface thereof to convert incident microwave energy to heat, said disk being supported on said support surface to define at least one air space between said container bottom on said disk; and a lid substantially transparent to microwaves and configured to cover said container to enclose said food item, and wherein said container body is circular in configuration to contain a circular food item and wherein said at least one raised land is configured as an annular ring spaced radially around a centerpoint of said container bottom.

10. The package assembly of claim 1 further comprising a plurality of raised lands integrally formed on said container body and together defining a support surface.

11. The package assembly of claim 10 wherein said plurality of lands is configured to form raised indicia readable upon viewing said container bottom.

12. The package assembly of claim 10 wherein a first portion of said plurality of lands is disposed proximate said side wall at spaced intervals therealong, and a second portion is disposed proximate a center point of said container bottom to facilitate movement of heated air through said air space.

13. The package assembly of claim 10 further comprising a spacer transparent to microwaves and disposed between said container bottom and said disk and including a second plurality of raised lands to define a second air space between said spacer and said disk.

14. The package assembly of claim 10 wherein said disk further comprises a plurality of apertures formed therein at locations thereon in registry with the plurality of raised lands such that each of said plurality of raised lands at least partially protrude through a corresponding aperture.

15. The package assembly of claim 14 wherein said container body is circular in configuration to contain a circular food item.

* * * * *